United States Patent [19]

Furst et al.

[11] Patent Number: 4,727,810

[45] Date of Patent: Mar. 1, 1988

[54] SAFE AND ARM DEVICE FOR A SECONDARY-EXPLOSIVE DETONATOR

[75] Inventors: Wilhelm Furst, Buchberg; Anton Brunner, Pappenheim; Manfred Klare, Neunkirchen a.Sand; Hartmut Gessler, Lauf; Dietmar Kugler, Ottensoos; Werner Rudenauer, Roth, all of Fed. Rep. of Germany

[73] Assignee: Diehl GmbH & Co., Nuremberg, Fed. Rep. of Germany

[21] Appl. No.: 20,107

[22] Filed: Feb. 27, 1987

[30] Foreign Application Priority Data

Mar. 27, 1986 [DE] Fed. Rep. of Germany ..... 3610358

[51] Int. Cl.[4] ..... F42C 9/00; F42C 11/04; F42C 15/24; F42C 15/32

[52] U.S. Cl. ..... 102/263; 102/208; 102/228; 102/489

[58] Field of Search ..... 102/262, 263, 259, 223, 102/208, 221, 489, 393

[56] References Cited

U.S. PATENT DOCUMENTS

| | | | |
|---|---|---|---|
| 3,861,312 | 1/1975 | Held et al. | 102/208 |
| 3,994,231 | 11/1976 | Rudeen et al. | 102/263 X |
| 4,157,068 | 6/1979 | Rognmo | 102/489 |
| 4,202,271 | 5/1980 | Day | 102/262 X |
| 4,380,197 | 4/1983 | Eaton | 102/228 |
| 4,421,030 | 12/1983 | DeKoker | 102/218 |
| 4,449,454 | 5/1984 | Liebhardt et al. | 102/226 |

FOREIGN PATENT DOCUMENTS 2931765 2/1981 Fed. Rep. of Germany .

OTHER PUBLICATIONS

Kooperation, in Entwicklung: endphasengelenkte Munition, p. 81, Sep. 1965.

Stanag Nr. 3525AA, Jan. 1976, vol. 23.

Military Standard, MIL-STD-1316C, Fuze Design, Safety Criteria for, Sep. 13, 1983, p. 8.

*Primary Examiner*—David H. Brown

*Attorney, Agent, or Firm*—Scully, Scott, Murphy & Presser

[57] ABSTRACT

A safe and arm device including a sensor-controlled switch arrangement in an electrical series-circuit, which is arranged ahead of a secondary-explosive detonator, especially for a submunition-projectile. The safe and arm device possesses a first switch which is actuatable at the presence of a surrounding air onflow against the submunition carrier in dependence upon a submunition ejecting command; and wherein a second switch is actuatable by the first switch when the submunition-projectile has released itself from its carrier and has implemented a transition into a gliding flight phase searching for a target.

9 Claims, 5 Drawing Figures

SAFE AND ARM DEVICE FOR A SECONDARY-EXPLOSIVE DETONATOR

BACKGROUND OF THE INVENTION

1. Field of the Invention

The present invention relates to a safe and arm device including a sensor-controlled switch arrangement in an electrical series-circuit, which is arranged ahead of a secondary-explosive detonator, especially for a submunition-projectile.

2. Discussion of the Prior Art

With respect to the foregoing, in particular there is contemplated a detonator for the warhead or combat charge of a submunition-projectile which is to be deployed through the intermediary of an airborne carrier, such as is described in the periodical WEHRTECHNIK, Volume 9/1985, page 81, upper part, with regard to its essential operational components.

The military safety criteria for fuzes (US-MIL-STD-1316C of Feb. 15, 1977, Section 4.3.3A, or NATO-STANAG 3525 AA of Jan. 23, 1976, Section 5) allow for the implementation of a safe and arm device without any mechanical interruption of an explosive train, when the function of the detonator for the triggering of the combat charge is predicated on the utilization of insensitive or inert explosive mixtures, so-called secondary explosives. For example, such a detonator is actuatable through the sudden-like discharge of high, accumulated electrical charges; for instance, across a piezo-electric transducer (German Pat. No. 29 31 765) or through an exploding electrical hot wire or detonator (U.S. Pat. No. 4,421,030, FIG. 2). However, in such a safe and arm device, provision must always be made that the transition from the secure or safe condition into the armed condition is only possible when there are given two mutually independent surrounding or environmental criteria, which ensure the orderly functioning of the ammunition.

In view of such requirements or demands, the safe and arm device of the type under consideration herein, is already equipped with a series-circuit of two sensor-switches which are connected in series with the detonator and the fuze element. However, for a desirable highly-energetic discharge of the fuze capacitor, the circuit provided therein is generally unsatisfactory, inasmuch as the capacitor for delivering the detonating energy is located in series with the series-circuit. Inasmuch as the firing criteria which are evaluated therein for the actuation of the switches, considerably restrict the capabilities of utilization of the previously known safe and arm device, since as they are both closed during the free flight of the projectile; in essence, upon the sensing of an onflow against the projectile and a firing acceleration over a sufficiently lengthy safety time interval.

SUMMARY OF THE INVENTION

Accordingly, in recognition of these conditions which are prevalent in the technology, it is an object of the present invention to provide a less complex but highly operationally-dependable safe and arm device of the type under consideration, which with regard to the switch functions and the assembly conditions, is especially suited for submunition-projectiles of the previously elucidated type.

The foregoing object is essentially attained in that the safe and arm device of the type considered herein possesses a first switch which is actuatable in the presence of a surrounding air onflow against the submunition carrier in dependence upon a submunition ejecting command; and wherein a second switch is actuatable by the first switch when the submunition-projectile has released itself from its carrier and has implemented a transition into a gliding flight phase searching for a target.

In accordance with the foregoing, for effecting the transition from the safe condition into the armed condition, the actuation of the first switch is initiated by the onflow against the carrier during free flight, but is only actually first released and functionally completed as a result of the mechanical separation of the submunition-projectile from its packing within the carrier; whereas the actuation of the second switch is initiated as a consequence of the closing of the first switch; however, which can only be actually implemented at a given free flight configuration of the ejected submunition-projectile.

An arming of the safe and arm device is, as a result, only possible when there are present at least the free flight conditions of the carrier, and thereafter the ejection of the submunition has also led to the free flight of the submunition-projectile; whereby there is safely avoided any premature arming and faulty detonation.

For the free flight-detection of the carrier, use can be made of a usual nose fuse with a fluid generator; for example, as disclosed in U.S. Pat. No. 4,421,030. The release of the submunition-projectile from its packing within the carrier and the transition into the free flight-phase of the submunition, can be detected in the simplest manner, most dependably and constructively through mechanical sensing of the structural elements of the carrier in the vicinity of the storage of the submunition, and from the structural elements of glide wings, which will release an obstruction or blocking element upon the outward swinging of the glide wings of the submunition.

Preferably, a positive mechanical coupling is arranged intermediate the operation of the two switches, in such a manner, that both switches can only first be transferred into the electrically transmissive or ON-position, when there have been fulfilled all operational criteria for the transition from the safe condition into the armed condition; in effect, when subsequent to the free flight of the carrier, there resulted the ejection of the submunition-projectile and the extension of its glide wings. For this purpose, there is functionally provided an energy accumulator between the power element which is actuated from the carrier for the operation of the first switch and this first switch, and a positive sliding guide or detent coupling between the two switches, such that the switches will alternatingly block their transfer into the applicable ON-position for as long as all criteria have not yet been fulfilled, whereupon there can be carried out the switching over from the previously charged energy accumulator or storage.

The inventive construction thus opens the possibilities of realizing an extremely effective safe and arm device for secondary-explosive detonators; whose electrical, mechanical and electro-mechanical components can be arranged within the smallest possible space, for instance, within an axially short and radially narrow section located in the body of the submunition. Hereby, the switches can be so constructed; for instance, through the arrangement of slide and lever guidances, that the accelerating forces generated during the start of the carrier and during the ejection of the submunition cannot produce any functionally-critical loads tending to act on the switches. In particular, one of the switches possesses a tripping pin oriented in the cross-section of the submunition along a tangential plane, which includes a sensor pin projecting through the casing surface of the submunition, which by means of a follower engages into an adjacently located switching arm of the other switch and which is pivotable in parallel with the longitudinal axis of the submunition, whereby this other switch extends in an axially-parallel manner through the plate segment-shaped assembly of the safe and arm device, so as to by means of the displacement of a blocking element, sense the completed outward pivoting of the glide wings of the submunition, and thereby the transition into the target searching phase, whereupon only then will there be carried out the arming with the charging of the fuze capacitor.

BRIEF DESCRIPTION OF THE INVENTION

Additional alternatives and modifications, as well as further features and advantages of the invention may now be readily ascertained from the following detailed description of a generally diagrammatically represented exemplary embodiment thereof, taken in conjunction with the accompanying drawings; in which.

DETAILED DESCRIPTION

Figure 2:
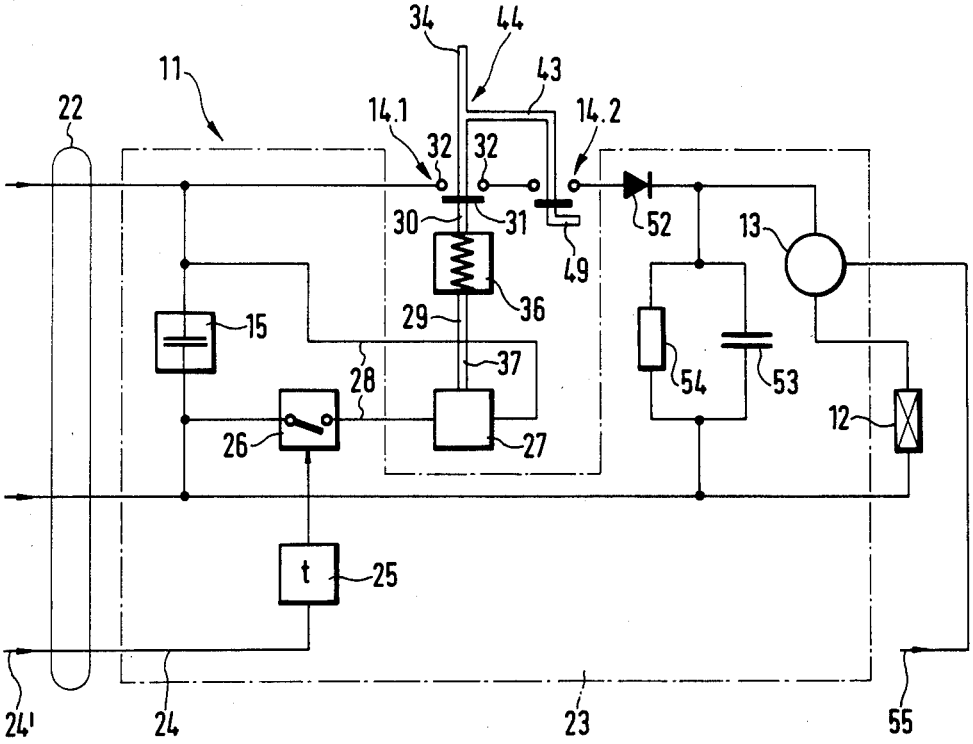
FIG. 2 illustrates a block circuit diagram of the series circuit of the switches for the safe and arm device within the submunition.

A submunition projectile 10 which is guided during its final phase of flight is equipped with an electromechanical safe and arm device 11 for an electrically-triggerable secondary-explosive detonator 12, which, through an electrical fuze element 13, inclusive of a parallel-connected fuze capacitor 53, in series with the series-circuit of two sensor-controlled electro-mechanical switches 14.2–14.1, is connectable to an electrical energy storage or accumulator 15 (FIG. 2). The latter can relate to a primary battery or to a secondary battery; or it relates, as illustrated, to an electro-physical accumulator or storage 15, which is charged up at a given time from an external energy source. In accordance with the extent of the capacitance, the accumulator 15 can also serve, as illustrated, for the supply of energy to further consumers when no independent accumulators are provided for such a purpose.

The carrier 16 for the submunition-projectile 10 is equipped with a generator-nose fuze 17 which, after the start of the rocket or the firing of the projectile from the carrier 16, is operated through the onflow 18 of surrounding air, and delivers electrical power to the charging capacitor or accumulator (for example, a capacitor or a secondary battery) of a central control circuit 19. After a certain flying distance, there is implemented either a program-controlled, remotely-controlled or sensor-controlled radial ejection of the submunition-projectile 10 from the casing structure 20 of the carrier 16, so that each of these submunition-projectiles 10, while guided through their search heads 21, home onto autonomous targets.

Shortly before the control circuit 19 initiates the ejection of the submunition.projectiles 10, by means of a make-and-break cable connection 22, there is effected a charging over of electrical energy into the individual submunition-energy storages 15 of the respective fuze circuit 23 in the safe and arm devices 11. Moreover, from the ejection command module 24' to the submunition-projectiles 10, through a trigger conduit 24 of the cable connection 22, there is triggered a timing circuit 25, which after the passage of a predetermined delay time period t, and thereby (at undisrupted operational sequences relative to the ejection of the submunition-projectiles 10) after leaving the carrier casing 20, will actuate a switch element 26 for the supplying of current to an electrically-triggerably pyroelectric power element 27 from the energy storage 15 through power supply lines 28 (FIG. 2).

Figure 3:
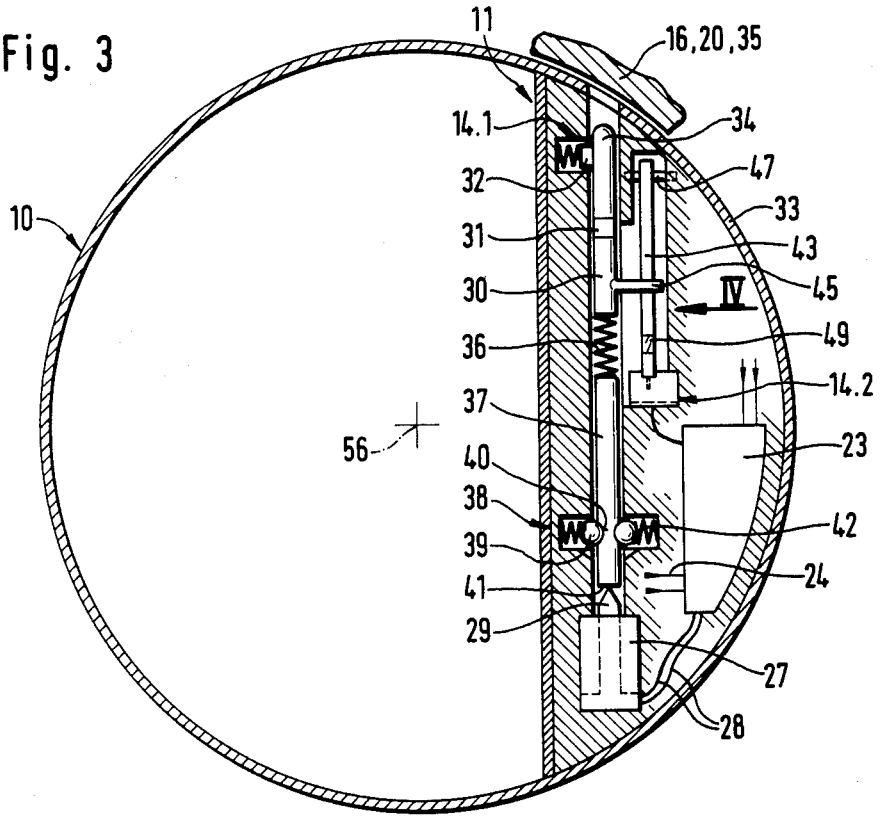
FIG. 3 illustrates the assembly of the safe and arm device and fuze device pursuant to FIG. 2 within the submunition, shown in a partial cross-sectional representation of the submunition.

The triggering of the power element 27 causes an axial displacement of a power element-striker 29 transversely of the longitudinal axis 56 of the submunition for the movement of a switching pin 30 from the OFF-position (shown in FIG. 3) into the ON-position of the first switch 14.1 of the above-mentioned series-circuit; whereby the electrical switching bridge pursuant to the embodiment of FIG. 3 is carried out in that only an axially limited region of the switching pin 30 evidences possesses an electrically-conductive surface, which will bridge over contacts 32 in the ON-position.

In any event, the striker 29 can only be advanced completely into the ON-position, when outside of the casing surface 33 the exit of a sensor pin 34 which is rigidly interconnected with the striker 29 is no longer blocked by a structural component 35 on the structure or the casing 20 of the carrier 16; in essence, the first switch 14.1 can thus only be closed for electrical transmissiveness, when the submunition-projectile 10 has actually released itself from its restraint within the carrier 16.

Inasmuch as the displacement of the switching pin 30 into the ON-position upon actuation of the power element 27 can still be temporarily mechanically blocked (for example, when operational malfunctions within the time interval t have not led to the radial dispensing of the submunition-projectiles 10), then the power element-striker 29 will not act directly on the switching pin 30, but through a spring-energy accumulator 36 which at the mechanical blocking of the switching pin 30 will only be tensioned by the striker 29. Thus, when first after the release of the power element 27 there is eliminated the blocking of the switching pin 30, thereafter the tensioned energy accumulator 36 serves for the displacement of the switching pin 30 into the ON-position.

In the exemplary case, as shown in FIG. 3, there is additionally inserted a transmission pin 37 into the operative connection between the power element 27 and the first switch 14.1; so as, on the one hand, not to require the first switch 14.1 and, on the orher hand, the electrically-triggerable power element 27 to be built directly proximate each other, but at constructively expedient locations. As a result thereof, especially obtained is also the necessary mounting space for a blocking device 38 between the power element 27 and the spring-force accumulator 36, which retains the latter and thereby also the switching pin 30 in an inactivated idle or OFF-position, for as long as the power element 27 has not yet been initiated. Concurrently, the blocking device 38 can be so designed as to retain the spring-force accumulator 36 in its charged position and thereby the switch pin 30 in its ON-position when subsequent to the actuation of the power element 27 because of certain reasons the rod 29 thereof is not latched in its extended position. In the illustrated exemplary case, the blocking device 38 possesses at least one ball or roll member 39 which spring-elastically contacts radially against the casing surface of the transmission pin 37, which member in the (as shown in FIG. 3) OFF-position engages into a detent 40 provided in the pin surface, and thereby arrests the transmission pin 37 in this position. The arresting force is only then overcome when the introduction of axial force is effected through the power element striker 29. The rearward end surface 41 of the transmission pin 37 is then raised above the radial contacting plane of the ball or roller member 39; for example, such that the roll member 39 is forced by a spring 42 behind the end surface 41 of the transmission pin 37 and wedged fast at that location, whereby the pin 37 will then (also at a reducing force exerted by the striker 29 in the raised position) axially support itself against the roll member 39.

For this radial movement of the roll member 39 behind the end surface 41 there is shown in FIG. 3, for simplification of the representation, a reduction in the end surface of the power element striker 29; instead thereof or in addition thereto, there can also be formed a reduction at the end of the transmission pin 37, about which there radially extends, in a surrounding collar-like projection, the supporting end surface 41 (not shown in the drawing).

Figure 4:
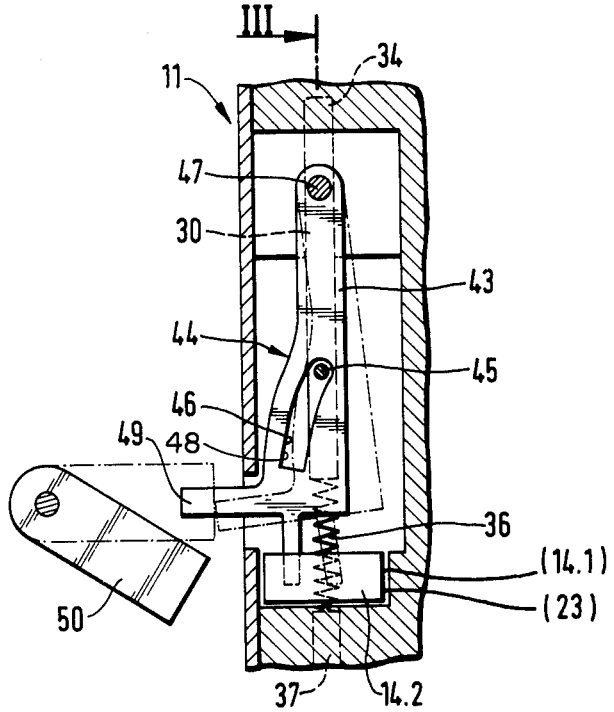
FIG. 4 illustrates the second switch in operative mechanical connection with the first switch, shown in a side view relative to the representation of FIG. 3.

The switching pin 30 of the first switch 14.1 includes a mechanical coupling to a tripping or switch arm 43 of the second switch 14.2, which is electrically connected in series therewith. This positive or guided coupling 44, pursuant to FIG. 4, is preferably implemented through the engagement of a switching pin follower 45 in an arcuately-extending guidance slot 46 formed in the switch arm 43 in such a manner, as shown in FIG. 4, that at the displacement of the switching pin 30 into the ON-position, the switch arm 43 will also be moved about a pivot axis 47 into its ON-position. Because of a portion 48 of the switch arm slot 46 initially extending in parallel relative to the movement of the switching pin 30 and thereby relative to its follower 45, the pivotal displacement of the switch arm 43 only first takes place at an increased sliding displacement of the switching pin 30; however, which is only facilitated when the blocking structural element 35 has released the sensor pin 34 for its egressing movement. Thus, the second switch 14.2 can then only close when the first switch 14.1 has previously moved into the ON-position, inasmuch as all mechanical and electrical prerequisites have been fulfilled with regard to the separation of the submunition-projectile 10 from the carrier 16.

On the other side, the switch arm 43 is equipped with a sensing angle member 49, which allows for the displacement of the second switch 14.2 into the ON-position only when, in the axial proximity of the safe and arm device 11, there is pivoted a blocking element 50 within the submunition 10 into its releasing position.

Figure 1:
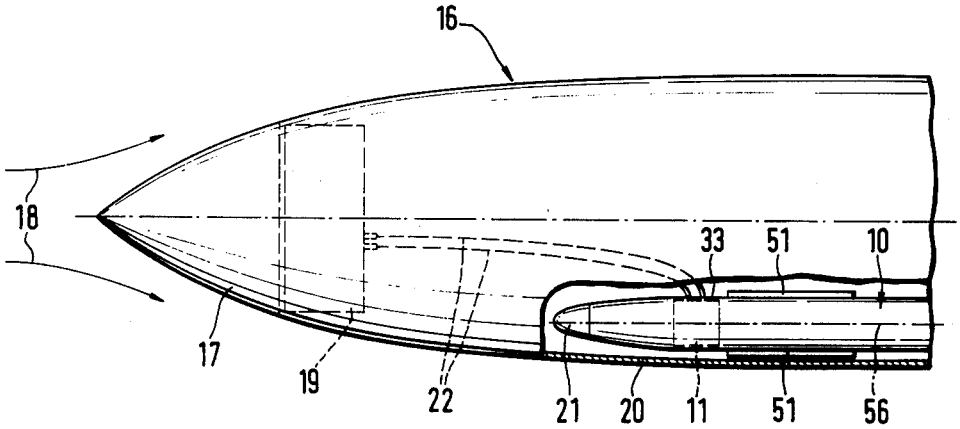
FIG. 1 illustrates a fragmentary and partially sectioned longitudinal view of a carrier missile with a submunition-projectile.

This blocking element 50 is preferably a structural component of outwardly pivotable glide wings 51 which are hinged to the casing surface 33 of the submunition-projectile 10, or a structural component which is in constructive operative connection therewith. Inasmuch as the outward extension of the glide wings 51 (FIG. 1) is carried out only a certain time interval after the ejection of the submunition-projectile 10 from its carrier 16 and the following stabilizing free-flight phase (initiated through a timing-control circuit on board of the projectile 10, which is not shown in the drawing); in essence, when this outwardly extending movement is no longer hindered by the submunition packing within carrier 16, there is first implemented the release of the sensing angle member 49 for the transition into the ON-position, when the submunition-projectile 10 is not only assuredly separated from the carrier 16, but that in addition thereto, its glide wings 51 have been extended. Until that point in time, the switch arm 43 is blocked by the element 50 in its OFF-position; and because of the positive guidance of the switching pin follower 45 in the arcuately-extending slide guidance slot 46, notwithstanding the release of the sensor pin 43, can the switch pin 30 be only slightly raised; however, it cannot be completely slid forwardly into its ON-position. Thus, through the intermediary of the positive coupling 44, there is provided an alternating mechanical latching of both switches 14.1, 14.2, which can only come into their ON-positions when, on the one hand, the power element 27 has been triggered, since the carrier 16 has been started, and on the other hand, the submunition-projectile 10 has not only been completely released from its packed position within the carrier 16, but in addition thereto has completed a transition with extended wings 51 into the target acquisition-glide path. The safety criteria of the two mutually independent surrounding conditions, which must be fulfilled for the arming of the safe and arm device 11, is thusly guaranteed.

This arming is hereby effected, when both switches 14.1 and 14.2 are closed in the series-circuit through the charging over of at least a portion of the electrical energy remaining in the energy storage or accumulator 15 after the triggering of the power element 27 through a feedback block 52 in the fuze capacitor 53, which is bypassed for the avoidance of undesirable static charges by means of a high-ohmic leakage impedance 54. When a search head 21 in the submunition detects and is homed onto a target object which is to be attacked, a fuse detector (for example, a proximity or an impact sensor) delivers a triggering command 55 to the electrical fuze element 13, for example, an ionization conductor section, so that the electrical energy stored in the fuze capacitor 53 in the armed position of the safe and arm device 11 will be suddenly discharged through the secondary-explosive detonator 12, so as to thereby detonate the combat or explosive warhead charge (not shown).

Figure 5:
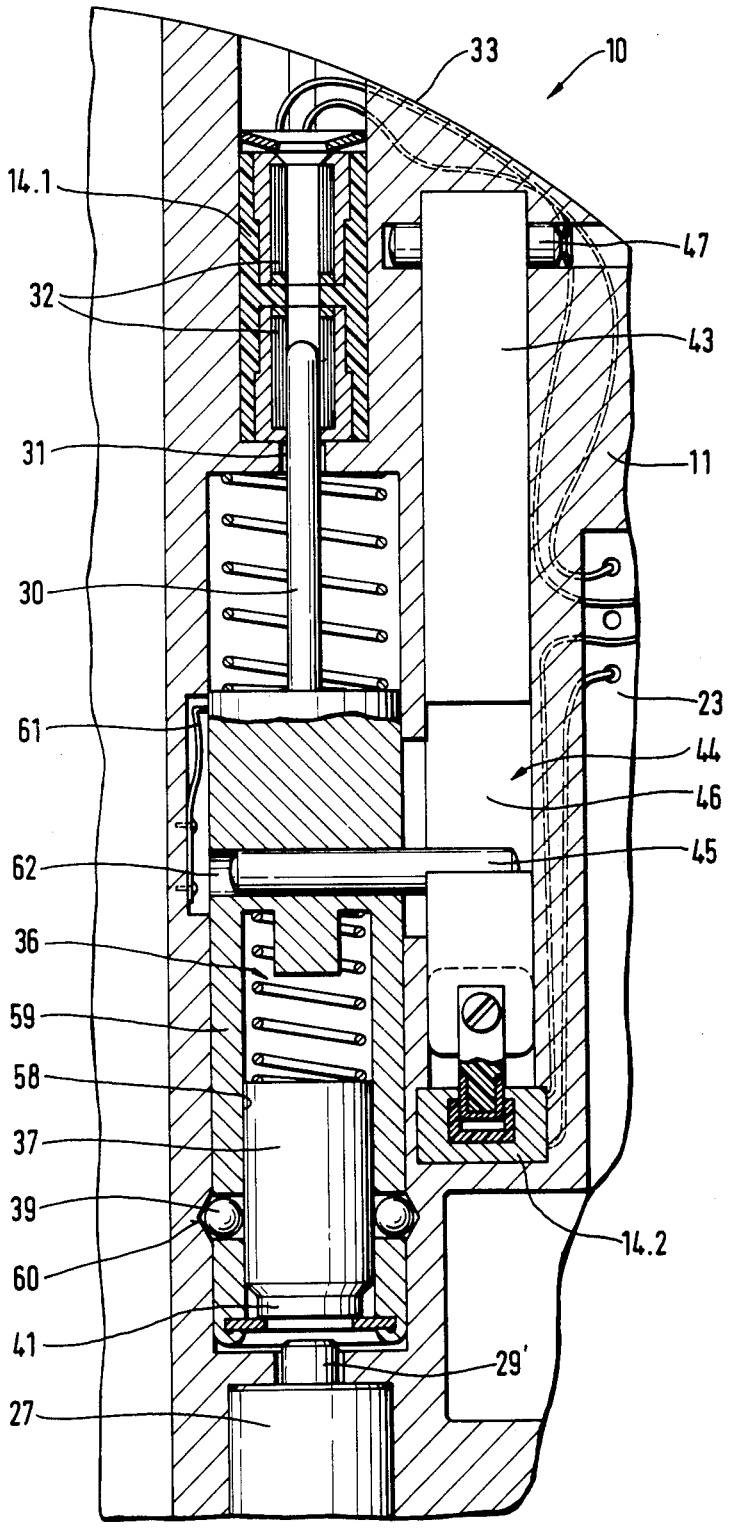
FIG. 5 illustrates, in conformance with FIG. 3, a detailed fragment of a modified switch actuating device.

The modification in the actuation of the first switch 14.1 from the power element 27, as illustrated in FIG. 5, possesses an advantage in comparison with the function of the switch actuation pursuant to FIG. 3, of an essentially greater shock-resistance against accelerations acting in the radial direction of the submunition-projectile 10; in effect, in the direction along the longitudinal axis of the switching pin 30. In accordance with FIG. 5, an acceleration force component in the direction of switching pin 30 can thus temporarily lead to the condition, that the transmitting pin 37 is temporarily somewhat displaced against the return force of the spring-energy accumulator 36; the actual switching pin 30 is not yet moved forwardly thereby, since it is still fixed by means of the roll member 39 in the safe and arm device 11. This arresting action is only then released when a longer encountered intense displacement force acts on the transmitting pin 37 for the stressing of the spring-energy accumulator 36, which in actual practice only occurs through the forward displacement of the striker 29 out of the power element 27. When the rearward end surface 41 of the transmitting pin 37 is then raised above the plane of the roll member 39, as a result the roll member 39 which contact against the wall structure 58 thereof and which extend through the wall structure of a rearwardly hollow-cylindrical casing 59 of the switching pin 30 up to in the detents 60 in the encompassing safe and arm device 11, so as to be released towards the inner space of the casing 59. Only when the roll member 39 are no longer pressed by the casing surface 38 of the pin into the detents 60, can the energy storage or accumulator 36 which is charged by the power element 27, while supported against the striker 29' raise the casing 59 including the switching pin 30 and the follower 45. For the securing thereof in the raised position, in which the first switch 14.1 is closed to provide electrical conduction, in the illustrated embodiment of FIG. 5, there is provided a bending or flexural spring 61 which is fastened to the safe and arm device 11, and after a sufficient stroke of the switching pin 30 will engage into a cutout 62.

What is claimed is:

1. In a safe and arm device for an air deployable carrier including a submunition separable from said carrier, said safe and arm device being disposed in an electrical series circuit between a controlled switch and a secondary-explosive detonator, the improvement comprising first and second switches disposed in electrical series with each other in said electrical series circuit, said first switch having a normally open position, a closed position, a switch element adapted to actuate said first switch from said normally open position to said closed position, and first means operatively coupled to said switch element of said first switch and responsive to the presence of an air onflow against said carrier after ejection of the carrier caused by a submunition ejecting command for actuating said switch element to move said first switch from said normally open position to said closed position, said second switch having a normally open position, a closed position, and a switch arm adapted to move said second switch from said normally open position to said closed position, and second means operatively connected to said switch arm of said second switch and responsive to the separation of said submunition from said carrier for actuating said switch arm of said second switch to move said second switch from said normally open position to said closed position when the submunition separates from said carrier, whereby said closed first and second switches electrically connect said controlled switch to said secondary explosive detonator.

2. A safe and arm device as claimed in claim 1, wherein said first means includes an energy accumulator for actuating said switch element of said first switch, means for delaying the charging of said energy accumulator a predetermined time following separation of the submunition from the carrier in response to said submunition ejecting command.

3. A safe and arm device as claimed in claim 1, wherein said submunition includes glide wings movable from stored to deployed positions upon separation of the submunition from the carrier, and said second means includes a blocking element having a position dependent upon the positions of said glide wings, and a sensing member for sensing the position of said blocking element.

4. A safe and arm device as claimed in claim 1, wherein said switch element of said first switch is axially displaceable in a plane perpendicular to the longitudinal axis of said submunition.

5. A safe and arm device as claimed in claim 1, wherein said switch arm of said second switch pivots about an axis in a plane perpendicular to the longitudinal axis of the submunition.

6. A safe and arm device as claimed in claim 1, wherein a positive-acting coupling is provided between said switch element of said first switch and said switch arm of said second switch.

7. A safe and arm device as claimed in claim 6, wherein said positive-acting coupling comprises a follower arranged on said switch element of the first switch, said follower being arranged in an arcuately extending sliding guide slot in said switch arm of the second switch.

8. A safe and arm device as claimed in claim 1, wherein a transmission pin with a return blocking means is arranged between a power element and an energy accumulator for the displacement of said switch element of the first switch, said transmission pin being displaceable by said power element.

9. A safe and arm device as claimed in claim 8, wherein said energy accumulator comprises a spring arranged in an inner space of a casing adjacent said switch arm of said first switch, said spring being chargeable from said power element through said transmission pin, roll members traversing the wall structure of said casing, said roll members being supported on one side thereof in detents formed externally of the casing and on the other side against the casing surface of the transmission pin in the still retracted position thereof.

* * * * *